United States Patent [19]

Hoffman

[11] 4,379,605

[45] Apr. 12, 1983

[54] ELECTRICAL RECEPTACLE OF MOLDED BODY CONSTRUCTION

[75] Inventor: Ernest G. Hoffman, Middlefield, Conn.

[73] Assignee: Harvey Hubbell Incorporated, Orange, Conn.

[21] Appl. No.: 207,345

[22] Filed: Nov. 17, 1980

[51] Int. Cl.[3] ..... H01R 13/38

[52] U.S. Cl. ..... 339/14 R; 339/97 P; 339/133 R

[58] Field of Search ..... 339/14 R, 97 R, 97 P, 339/98, 99 R, 133

[56] References Cited

U.S. PATENT DOCUMENTS

| | | | |
|---|---|---|---|
| 2,315,523 | 4/1943 | Hubbell | 339/133 R |
| 3,723,948 | 3/1973 | Wyatt et al. | 339/14 R |
| 4,196,956 | 4/1980 | Hoffman | 339/107 |

OTHER PUBLICATIONS

AMP 60 Second Wiring Devices.

AMP Miscellaneous Products–Data Sheet No. 74–262, 7–1976.

AMP Home Wiring (HW–11) Instruction Sheet IS 7708, 4–1976.

*Primary Examiner*—Joseph H. McGlynn

*Attorney, Agent, or Firm*—Jerry M. Presson

[57] ABSTRACT

A general purpose receptacle having selective single and split circuit electrical modes is adapted for mounting in a standard floor or wall mounting box. The receptacle is formed of a molded, one-piece receptacle body and a molded, one-piece receptacle front. Selection of single or split circuit operating modes is achievable by a break-off tab which normally electrically connects two sets of female contacts as a single circuit but which can be broken off so that the female contact sets are electrically separated. The receptacle is wired by placing the unstripped ends of insulated conductors at insulation severing terminals connected to the female contacts and forcing the conductors into the terminals. To accomplish this, a pair of suitably shaped side covers are hinged to the front part of the receptacle top to provide the requisite insulation-displacement forces. With the side covers secured in position, no terminals are exposed which might otherwise make electrical contact with metallic parts of the mounting box. Mounting, insulation severing and circuit mode selection can all be performed by using a screwdriver.

42 Claims, 5 Drawing Figures

Fig. 2.
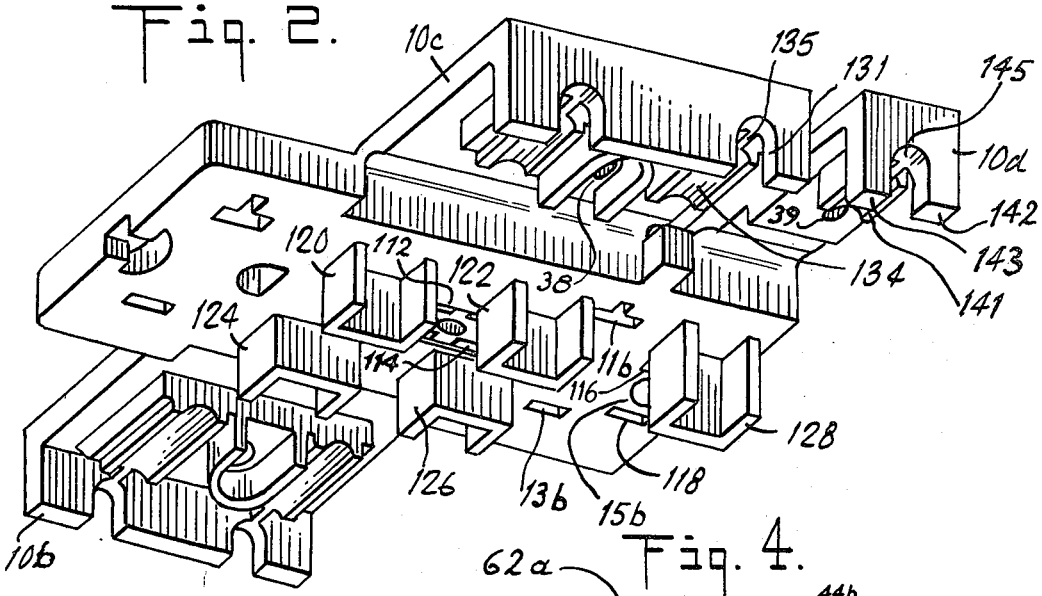
Fig. 4.
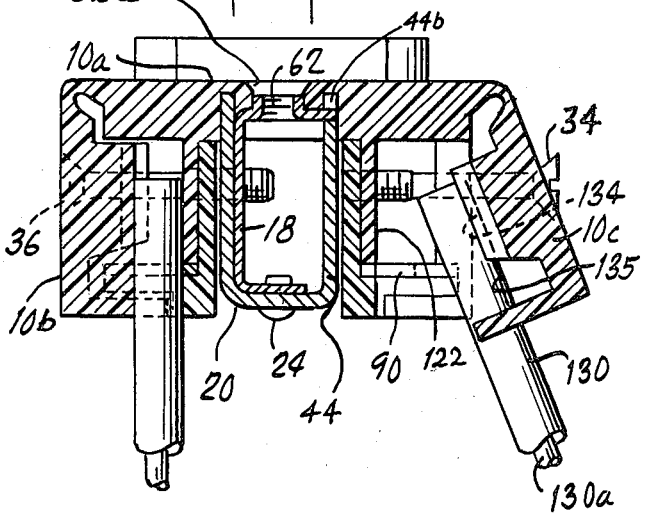
Fig. 3.
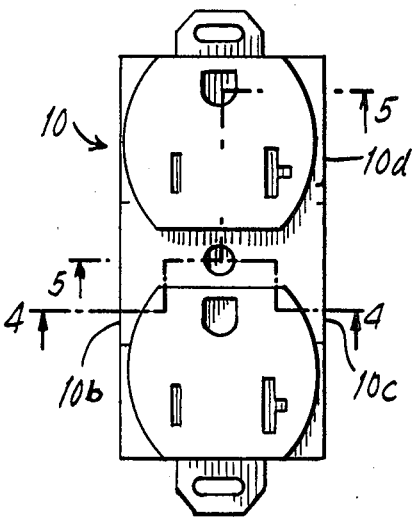
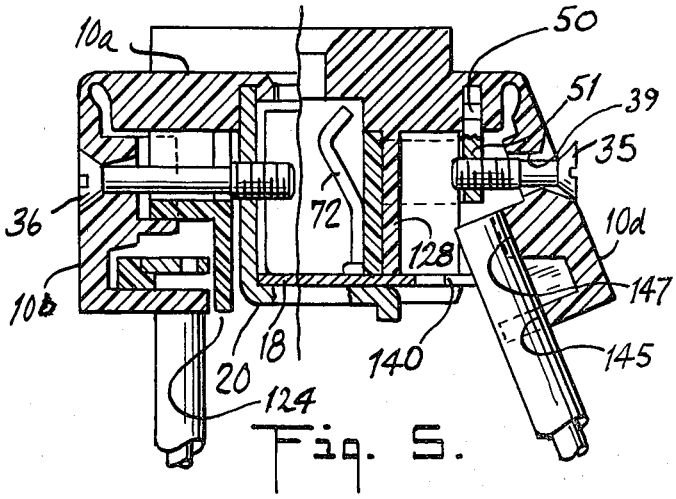
Fig. 5.

ELECTRICAL RECEPTACLE OF MOLDED BODY CONSTRUCTION

BACKGROUND AND SUMMARY OF THE INVENTION

The invention relates to electrical wiring devices and more particularly to duplex electrical receptacles and housings therefor which are suitable for mounting in conventional wall boxes.

Duplex electrical receptacles may be categorized as either general purpose or self-contained receptacles. As is well known, general purpose duplex receptacles are typically designed to have two sets of two or three female contacts in each set, depending upon whether the receptacle is of the ungrounded or the grounded type. In the grounded type of receptacle, electrical connections are made to the ground terminals as well as to the power and neutral terminals. In ungrounded receptacles, ground terminals are eliminated.

General purpose receptacles usually have both a single and a split (or dual) circuit operating capability. Usually, the split circuit mode is used when each set of contacts is to be fed electrical power from independent circuit sources. The single circuit mode is usually used when it is desired that the electrical current supplied to the one set of contacts also feed-through to the other set of contacts and possibly to more downstream connected wiring devices coupled into the receptacle circuit.

A slotted tab provided in the electrical structure joining the different sets of contacts may be broken off by a screwdriver blade tip inserted into the tab or by pliers to convert the receptacle from the single circuit mode to a split (or dual) circuit mode. With the receptacle connected in a split circuit mode, both sets of contacts can be operated independently of each other. For example, one-half of the receptacle can be selectively energized by operation of an electrical wall switch connected to only the one set of contacts mounted in that one-half while the other set of contacts mounted in the other half of the receptacle can be energized continuously from conductors connected to the source of circuit power or through an upstream wiring device, such as another receptacle.

Self-contained receptacles as compared to general purpose receptacles, are designed to have only a feed-through or single circuit capability but do not have a split circuit capability. Moreover, because of their construction, fire code requirements presently limit installation and usage of self-contained devices to the first two levels of a building or other structure. The receptacles are primarily designed for assembly with special purpose assembly tools and usually can only be connected with non-metallic, sheathed cable. Because of their different-than-standard usage sizes and special mounting requirements, self-contained receptacles are usually not interchangeable with the aforedescribed general purpose receptacles. Moreover, the design of the housings of self-contained receptacles does not permit them to be mounted in the general purpose type of metallic wall boxes which are designed to accommodate various types of general purpose receptacles.

The insulated conductors may be connected to terminals of the self-contained receptacles by use of the so-called "insulation-displacement" technique. This technique typically involves pushing a conductor into a terminal slot such that the slot penetrates or cuts through the conductor insulation sufficiently to make electrical contact with the underlying conductor wire. One way to do this is by use of a special parts-clamping tool, resembling a large hand pliers. Proper operation of this tool requires a modicum of skill and dexterity by the installer and convenient access to the wire and terminal slots. The insulation-displacement technique is a wire connecting technique which has been used with male and female electrical contacts in single circuit types of wiring devices, as described in my U.S. Pat. No. 4,196,956, assigned to the same assignee as this application.

The invention constructed in accordance with this invention is a receptacle and a housing therefor of the general purpose type with single and split circuit capability. The receptacle is adapted for mounting in standard or general purpose wall or floor boxes and may be easily and readily wired to associated electrical conductors by forcing the conductors into terminals with the side covers of the receptacle which side covers then complete the enclosure of the receptacle housing.

More specifically, a receptacle made in accordance with the invention is virtually independent of the quality of workmanship used in its installation and is fully insulated when installed such that there are no exposed live parts. This is a particularly important safety feature because it ensures that the electrified terminals cannot inadvertently make electrical contact with the metal portions of the receptacle box in which such receptacles are usually mounted. The receptacle of this invention is constructed such that it can be used with conductors varying in size over a relatively wide range and, moreover, the receptacle is reusable and can be rewired repeatedly. The general size and manner of use of the instant receptacle is similar to that of a conventional screw-terminal receptacle, to minimize the chance of improper installation due to unfamiliarity. Additionally, a portion of the conductor on both sides of the contact terminal is provided with a measure of strain relief. This is an important feature because the receptacle must be pushed back into its wall box after connection is made between the contact terminals and conductors, and this movement may cause the conductors to loosen in their associated contact terminals leading to electrical failures.

A receptacle forming a specific embodiment of the invention is made up of two molded components composed of suitable polymeric compositions and several stamped sheet metal components, and is assembled with the help of standard assembly screws. One of the plastic components is a receptacle body which may be composed of a thermosetting or a thermoplastic compound, such as nylon, and the other is a receptacle front cover having two side covers hinged thereto by respective integral web hinges. A pair of terminal members each having power contacts and power insulation-displacement (or insulation penetrating) terminals are inserted into the receptacle body. A metal yoke, with a metal piece having ground contacts and an insulation displacing ground terminal secured to the yoke, is mounted on the receptacle body such that the rearward part of the yoke cradles the receptacle body. The yoke has several frontwardly-extending yoke projections which are received with interference fits in slots formed in the underside of the receptacle front cover. The yoke projections engaging the walls of the slots serve as the principal connective means for joining the receptacle body to the front cover. The ground contacts and a wall plate screw tab also extend through a suitable pocket in the receptacle body.

The insulation-covered ends of power and ground wires are placed opposite their respective terminal slots, which face outwardly from two sides of the receptacle body, and the side covers are pivoted toward the receptacle body to push the conductors into the slots, displacing portions of the insulation coverings in the process to make electrical connections therebetween. The side covers are secured by way of suitable assembly screws, which when tightened, help ensure that good electrical connections are maintained between the conductors and their respective terminal slots. The side covers are constructed to grip the insulation coverings of wires so as to provide strain relief for the wire terminations. More detailed aspects of the invention will become apparent from the detailed description below.

BRIEF DESCRIPTION OF THE DRAWINGS

FIG. 2 is a perspective view of a receptacle front, shown as molded, which forms a part of the receptacle shown in FIG. 1 and is seen from the back side thereof.

FIG. 3 is a front view of the receptacle shown in FIG. 1, as assembled.

FIG. 4 is a sectional view along lines 4—4 of FIG. 3.

FIG. 5 is a sectional view along lines 5—5 of FIG. 3.

DETAILED DESCRIPTION

Figure 1:
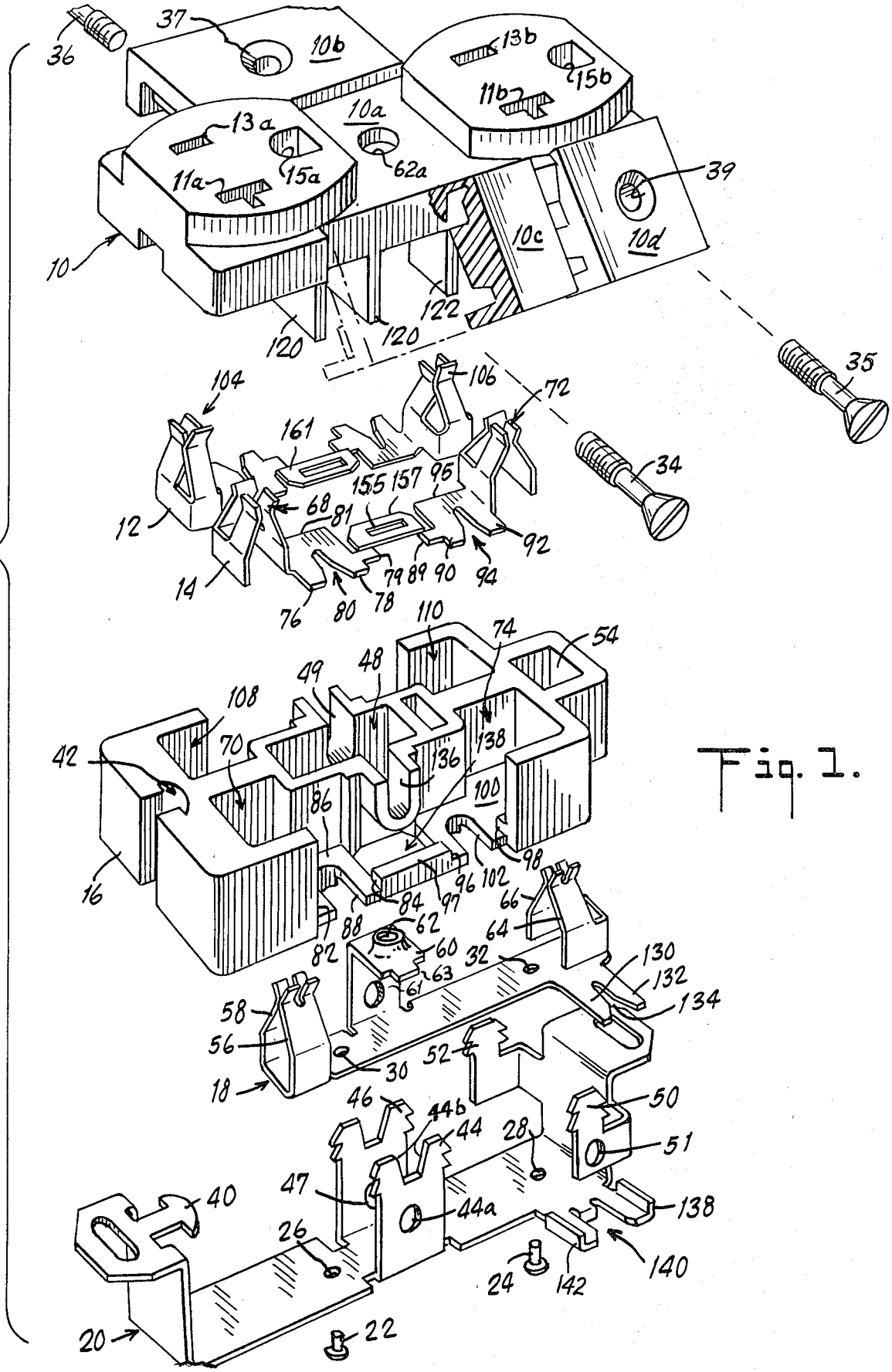
FIG. 1 is an exploded perspective view of the main parts of a receptacle which embodies the invention.

A receptacle which forms an embodiment of the invention comprises a receptacle front member 10, a pair of power blade connector straps 12 and 14, a receptacle body 16, a ground blade connector strap 18 and a yoke 20. The receptacle front member 10 comprises a front cover of generally rectangular shape and designated 10*a*, a pair of power contact side covers generally designated 10*b* and 10*c*, respectively, and a ground contact side cover generally designated 10*d*.

The front cover 10*a* has two sets of apertures or slots extending perpendicularly therethrough to accommodate the various conductive blades of one or two male plugs inserted into the receptacle. The number of apertures and their configurations will, of course, depend upon the particular application or use to which the receptacle is to be put. The receptacle as illustrated has two sets of power blade apertures, designated 11*a* and 11*b*, respectively; two sets of neutral blade apertures designated 13*a* and 13*b*, respectively, and two sets of ground blade apertures, designated 15*a* and 15*b*, respectively, to accommodate conventional three-blade plugs. If the receptacle is not a grounding type, the ground apertures 15*a* and 15*b* may be omitted and only two apertures provided in each set; a power and a neutral aperture oriented in substantially parallel alignment. The entire receptacle front member is integrally molded with the side covers hinged to the front cover by means of "live" or web hinges.

The ground connector strap 18 and yoke 20 are assembled into a unit by means of rivets 22 and 24 which pass through respective openings 26 and 28 in the yoke 20 and through respective openings 30 and 32 in the ground connector strap 18 and have their ends peened over to fixedly secure the strap 18 and yoke 20 together in good electrical contact. The receptacle further comprises a pair of side cover assembly screws 34 and 36 and a ground contact assembly screw 35 which, as described below, assist in the assembly and wiring of the receptacle.

To assemble the receptacle, the ground blade connector strap 18 is placed inside the yoke 20 and riveted together and the sub-assembly is inserted into the receptacle body 16 from the bottom thereof as seen in FIG. 1. A dovetail 40 of the yoke 20 fits within a mating guide slot 42 in the receptacle body to secure this end of the yoke to the receptacle body. In this position, a pair of projections 44 and 46 fit within pocket or cavity 48 in the receptacle body 16, another pair of projections 50 and 52 fit closely around the outside of the side walls forming another pocket 54 in the receptacle body 16, a pair of grounding blades 56 and 58 forming one of the ground contacts fit and are thereby housed within the pocket 48 in the receptacle body 16, toward the left-hand side of that pocket as seen in FIG. 1.

The grounding strap 18 includes a tong 60 having at its top a threaded wallplate screw hole 62 aligned with wallplate aperture 62*a*. The tong 60 positioned against the inside surface of the projection 46 is, along with projection 46, housed by the pocket 48. To render greater stability to the cantilevered end of the tong bearing the screw hole 62, tip portion 63 of the tong may be shouldered to seat against the opposite inwardly inclined edges 44*b* of the projection 44, FIG. 4. In any event, the screw opening 61 of greater diameter than the screw 36 is substantially aligned with a threaded opening 47 in the projection 46 to permit unimpeded inward axial movement of the screw 36 through the opening 47 upon rotation of the screw during cover closure.

Another pair of ground contact blades 64 and 66, forming another ground contact of the ground connector strap 18 fit within and are thereby housed by the pocket 54. The guide slot 42 and pockets 48 and 54 in the receptacle body 16 extend through the entire receptacle body and are open at their bottom ends, which are not visible in FIG. 1.

The power connector strap 14 is inserted into the receptacle body 16, by dropping it into the body 16 from the top thereof as seen in FIG. 1, such that its blades forming a power contact, generally indicated at 68, fit within a pocket 70 in the receptacle body 16 and its blades forming another power contact generally indicated at 72 fit within another pocket 74 in the receptacle body 16, its pair of legs 76 and 78, which define a generally V-shaped insulation-displacement slot 80 therebetween, fit between abutments 82 and 84 of the receptacle body 16 and over a land 86 having a U-shaped slot 88 which is large enough to accommodate the largest conductor to be wired into the receptacle, and legs 90 and 92 defining between them a generally V-shaped insulation-displacement slot 94 fit between similar abutments 96 and 98 over a similar land 100 having a similar slot 102. When so positioned, a break-off tab 157 is located over a cavity 138 behind an upstanding land 97 extending between the abutments 84 and 96. Tabs 79 and 89 are positioned to abut the land 97 and thereby limit outward movement of the slots 80 and 94 in a direction perpendicular to the longitudinal axis of the device 10 whether the tab 157 is broken off or not. The land 97 also serves as a fulcrum for the blade of a screwdriver which may be inserted in a slot 155 to bend and thus break the tab 157 from its supporting tabs 79 and 89, respectively. As will be apparent, the outer edges of the legs 76, 78 and 90, 92 will bear against abutment 82, 84 and 96, 98, respectively, to restrain the contacts 90 and 94, respectively, against movement in directions parallel to the longitudinal axis of the device 10. The inward edges 81 and 95 of the respective contacts 80 and 94 bear against the surfaces of the pocket 48 adjoining the lands 86 and 100, respectively.

The power blade connector strap 12, which is a mirror image of the strap 14, fits similarly in the receptacle body 16 such that its power blades generally indicated at 104 and 106 fit within pockets 108 and 110, respectively, of the receptacle body 16, an its insulation-displacement slots fit between similar abutments and over similar lands.

The front member 10 is fitted to the thusly assembled components by aligning the tops of the projections 44, 46, 50 and 52, which protrude above the top of the receptacle body 16, with matching rectangular slots 112, 114, 118 and 116, respectively, formed in the back of the front cover 10*a* of the front member 10, FIG. 2. The projections 44, 46, 50 and 52 each have a plurality of sharp barbs on the outer edges of their top ends and are spaced apart far enough to bite into the opposite ends of the plastic walls defining the corresponding slots 112-118 in the front cover 10*a*. These barbs engaging the slot walls thereby secure together, with an interference fit, the entire assembly made up of the front cover 10*a*, the power blade connector straps 12 and 14, the receptacle body 16, the ground blade connector strap 18 and the yoke 20. The slots 112 and 114 receiving the barbed ends of the projections 44 and 46, respectively, are partially visible in FIG. 2, and may be positioned on opposite sides of the wall plate aperture 62*a*.

The front cover 10*a* includes integrally molded projections 120 and 122 positioned and dimensioned such that projection 120, which is generally U-shaped in section with the open side facing outwardly, presses the legs 76 and 78 defining the slot 80 onto the land 86 and the projection 122, of generally U-shape in section, similarly presses the legs 90 and 92 defining the insulation-displacement slot 94 against the land 100. The free ends of the projections 120 and 122 press against the legs defining the respective insulation-displacement slots to resist bending and deformation of the respective legs by forces applied in directions transverse to the plane of the legs when conductors are pushed into the insulation-displacement slots. The projections also provide a three-sided insulated housing around the edges defining each slot. The open side of each housing is wide enough to accommodate the end of an insulation-covered wire which is forced into an underlying insulation-severing slot. Similar projections 124 and 126, of generally U-shaped in section, press the insulation-displacement slots of the power connector strap 12 against similar lands and between similar abutments, and another projection 128 fits over the surfaces of two legs 130, 132 which define a ground conductor insulation-displacement slot 134. The two legs 130, 132 are is located inwardly of two integrally formed, opposed legs 142 and 143 which define therebetween a U-shaped slot 145 dimensioned to accept the heaviest ground conductor for which the receptacle is designed.

When so assembled, the receptacle is ready to be wired. The unstripped ends of power and ground conductors are placed at the respective power and ground insulation-displacement slots, as illustrated in FIGS. 4 and 5, and the side covers are pivoted toward the receptacle body 16, initially by hand and then with the assistance of the assembly screws 34, 35 and 36. Referring as an example to FIG. 4, the unstripped end of a power conductor 130 is placed at the insulation-displacement slot 94, which is visible in FIG. 4, and the power side cover 10*c* is pivoted toward the receptacle body 16 such that the slot 131 in the cover 10*c* and the pusher block 134 on the inside of the side cover 10*c* engage the insulated sheath of the conductor 130. The web portion 135 of the pusher block 134 is aligned with the slot 94 and can freely enter it. The power assembly screw 34 passes through the opening 38, FIG. 2. The screw 34 also passes freely through the U-shaped insulating barrier 136 in the receptacle body and is threaded into the threaded opening 44*a* in the projection 44 of the yoke 20. Upon tightening the power blade assembly screw 34, the conductor 130 is pushed progressively into the insulation-displacement slot 94 until the slot cuts through the insulation and makes electrical contact with the underlying conductor wire 130*a*. It is noted that the pusher block 134, web 135 and the edges of the slot 131 engage a length of the insulated sheath of the conductor 130, pressing it against mating parts of the receptacle body 16, to provide a degree of strain relief against tensile forces applied to the conductor. Any other power conductor and the ground conductor are wired similarly and are similarly held to provide strain relief. A separate side cover 10*d* and a separate assembly screw 35, extending through opening 39 in side cover 10*d* and threaded in the opening 51 of projection 50, are used in a similar manner to wire the ground conductor. As illustrated in FIG. 4, assembly screw 36 passes through opening 37 (FIG. 1) in side cover 10*b* and threads into opening 47 of projection 46, with any protruding part of the screw tip extending through opening 61 in the grounding strap 18 and into the open area between the projection 44 and the tong 60 of the grounding strap.

The terminal action is not adversely affected by the offset loading produced by only one conductor each in the hot and neutral terminal. To use the receptacle as a split circuit receptacle, the tab 157 (FIG. 1) in the power connector 14 and the tab 161 in the power connector 12 can be broken off with the screwdriver used to effect wiring and installation of the receptacle.

To facilitate manufacture of the receptacle, the ground strap 18 and the yoke 20 could be made as a single integral metal part rather than two individual parts connected by the rivets 22 and 24. In addition, the projections 44 and 46 could be positioned at the end of the yoke 20 opposite that from which the projections 50 and 51 depend and the housing 16 recessed to receive these projections to depend therefrom in the same way as the projections 50 and 51 depend from their end of the yoke. Other similar changes could be made to the receptacle without departing from the scope of the invention.

As will be appreciated, when assembled and wired, the insulated housing of the receptacle fully encloses all electrically live parts to thereby reduce danger of electrical shock.

The orientation of the elements of the receptacle has been described for the usual case, that is, the receptacle is mounted with the front cover 10*a* extending along a vertical plane and being the "front" of the receptacle. As will be understood, it is possible to mount the receptacle in other orientations without departing from the spirit of the invention.

I claim as my invention:

1. A general purpose type of duplex receptacle comprising:

a receptacle body having a plurality of side walls;

a front cover mounted on said side walls;

at least one side cover connected to said front cover by a web hinge to pivot relative thereto toward and away from said receptacle body;

first and second groups of spaced-apart receptacle apertures extending through said front cover, each group of apertures accommodating the male blades of a male plug insertable into one or both of the groups, a plurality of female contacts made of electrically conductive material, each of said female contacts mounted in substantial alignment with a different one of the apertures for making electrical contact with a corresponding blade of a male plug in an aperture;

a plurality of terminal members composed of electrically conductive material mounted in the receptacle body connected to different ones of said female contacts, each of said terminal members having an insulation severing portion whereby electrical contact may be made with an insulation-covered conductor wire by penetrating the insulation:

means for electrically connecting a first one of said female contacts in the first group of apertures with a first one of said terminal members and means for electrically connecting a second one of said female contacts with a second one of said terminal members;

the one side cover having conductor pusher surfaces, operative when said at least one side cover is pivoted toward said receptacle body, to press an insulation-covered conductor having an unstripped free end placed on one of said terminal members against the one terminal member to cause severing of the conductor insulation by said one terminal member and the making of an electrical connection therebetween.

2. The receptacle as in claim 1 and further comprising, a break-off tab joining the first and second terminal members for selectively electrically connecting the first and second terminal members whereby the receptacle functions either in a single circuit mode or in a split circuit mode.

3. A general purpose receptacle as in claim 1 in which each of said terminal members comprises, a pair of legs defining a generally V-shaped slot therebetween, and in which said body includes abutment means which flank the legs of each such slot to resist spreading thereof when insulated conductors are pushed into the slot and facilitate the making of electrical contact between the slot and the wire of a conductor pushed therein, and to facilitate reusability of the receptacle.

4. A general purpose receptacle as in claim 1 or 3 in which the receptacle body has a back and including a yoke cradling the receptacle body and having a major portion fitted to the back of the receptacle body and projections extending frontwardly therefrom, through the receptacle body, said projections having engaging means at their front ends and said front cover of the receptacle having mating engaging means, said engaging means of the yoke projections and of the front cover interlocking upon assembly by forcing the yoke and the front cover toward each other to secure the yoke, said receptacle body and said front cover to each other.

5. A general purpose receptacle as in claim 1 or 3 in which the insulation severing terminal members and contacts comprise power terminals and contacts and a ground terminal and at least one ground contact and wherein said at least one side cover is aligned with and cooperates with the power terminals, a second side cover pivotally mounted on said front cover in alignment with the ground terminal, and web hinge means joining said second side cover to said front cover for pivotal movement.

6. The receptacle as in claim 1 or 3 in which the insulation severing terminal members comprise a first set of terminals having slots facing outwardly relative to a first side of the receptacle body and a second set of terminals having slots facing outwardly relative to a second side of the receptacle body, and wherein said at least one side cover comprises a first side cover aligned with and cooperating with said first set of terminals and a second side cover aligned with and cooperating with said second set of terminals.

7. A general purpose type of duplex receptacle, comprising:

a receptacle housing of generally overall rectangular shape composed of an electrical insulating material and including a back cover portion, a front cover, and two at least substantially parallel side covers, one of said side covers hinged to the front cover to pivot relative thereto toward said receptacle housing;

first and second groups of apertures arranged in mutually spaced-apart relationship extending inwardly of the front of said receptacle body, each group of apertures accommodating the male blades of a male plug insertable into one of the groups, a plurality of female contacts mounted in said housing and composed of electrically conductive material, each of said female contacts mounted in alignment with a different one of the apertures and facing frontwardly for making electrical contact with a corresponding blade of a male plug;

insulation severing terminals composed of electrically conductive material mounted in the receptacle body, said terminals having respective insulation severing portions facing outwardly relative to at least one of said side covers, means for electrically connecting a first one of said female contacts in the first group of apertures with a first one of said insulation severing terminals and means for electrically connecting a second one of said female contacts in the second group of apertures with a second one of said insulation severing terminals;

said one side cover having engagement means, operative when said at least one side cover is pivoted to push into said terminals insulated conductors having unstripped free ends placed at the terminals to cause severing of the conductor insulation by said terminals and making electrical contact between the respective terminals and conductor wires; and conductor strain relief means mounted on said one side cover for engaging the conductor insulation to resist removal of the conductors from the receptacle.

8. A housing for an electrical wiring device composed of an electrical insulating material comprising:

an elongated frontal member having substantially parallel, opposed side edges and a longitudinal axis extending substantially midway between said side edges, said frontal member having a plurality of apertures extending therethrough, first and second ones of the apertures positioned substantially symmetrically relative to said longitudinal axis for accommodating power and neutral contact blades, respectively, and a third one of said apertures being substantially aligned with said longitudinal axis to accommodate a ground contact blade;

first, second and third cover members;

web hinges integral with said frontal member and the cover members for pivotally connecting the first cover member to one side edge of said frontal member and for connecting said second and third cover members to a second edge of said frontal member in substantially juxtaposed relationship;

said cover members being moveable independently of one another from an open position wherein access is provided to the housing interior to a closed position wherein the housing interior is partially enclosed thereby, said first and second cover members being moveable about the axes of the connecting web hinges in respective planes which include the power and neutral apertures, respectively, and said third cover member being moveable about the axis of its connecting web hinge in a plane which includes the ground aperture.

9. The housing according to claim 8 wherein said second side edge of said frontal member is recessed opposite respective ones of said web hinges so that frontal portions of said cover members are moveable inwardly of said second side edge when said cover members are moved to the closed position.

10. The housing according to claim 8 wherein said second and third cover members are spaced apart by an outwardly extending land formed between adjacent, spaced apart recesses in said second side of said frontal member.

11. The housing according to claim 8 wherein the cover members are substantially of L-shape configuration.

12. A duplex receptacle, comprising:

a receptacle body having a plurality of opposing side walls and a rear wall joined to said side walls;

a front cover mounted on said side walls;

said receptacle body and said front cover composed of a plastic insulating material;

a yoke composed of an elongated strip of electrically conductive material for grounding the receptacle, said yoke mounted on said rear wall of said receptacle body and having the opposite ends thereof extending frontwardly adjacent different ones of said side walls to a position adjacent said front cover;

a grounding contact electrically connected to said yoke and communicating with an aperture extending through said front cover;

two pairs of metallic projections joined to said yoke and extending frontwardly from said yoke;

a plurality of surfaces defining slots in the interior of said front cover, said projections entering said slots and bearing against the surfaces thereof to secure said front cover to said receptacle body;

the periphery of said receptacle body being recessed to allow for the passage of said projections toward said front cover;

each of said pairs of said projections mounted adjacent a different end of said yoke; and, a barbed element on the end of each of said projections for engaging a surface defining a slot in said front cover.

13. A duplex receptacle comprising:

a frontal portion, two opposite side portions and a rear portion composed of electrical insulating material;

a ground terminal mounted in one of said side portions;

a plurality of power terminals and a plurality of neutral terminals for a plurality of electrical circuits feeding electrical power to and/or through the receptacle mounted in respective opposite side portions;

at least two movable side covers composed of electrical insulating material overlying said opposite side portions for covering said plurality of power and neutral terminals, respectively, and a third side cover for covering said ground terminal;

a plurality of web hinges pivotally connecting said side covers to said frontal portion, said hinges being formed as integral parts of said frontal portion and said side covers;

means formed on each of said side covers for clamping individual electrical conductors connected to different ones of said terminals against displacement; and a plurality of screw means engaging interior portions of said receptacle body and passing through each of said side covers medially of the ends thereof for driving said side covers toward the conductors as the corresponding screw means is tightened.

14. The receptacle as claimed in claim 13, wherein said rear wall has a plurality of spaced-apart edges of substantially U-shape formed therein to define a plurality of juxtaposed open-ended slots facing corresponding side covers, each of the slots lying in substantial alignment with each one of said clamping means and cooperating therewith for clamping conductors to the receptacle;

and wherein each of said terminals is located frontwardly of the slots in said rear wall.

15. An electrical wiring device to which an electrical cord including a plurality of individual, insulated conductors may be electrically wired, the device having a longitudinal axis and comprising:

a housing including an elongated front cover of substantially rectangular configuration and composed of an electrical insulating material disposed parallel to the longitudinal axis of the device, said front cover having respective frontal and rearward surfaces and respective first and second side edges;

a plurality of spaced-apart openings extending substantially perpendicularly through said front cover;

a plurality of elongated contact blades fixedly mounted in spaced-apart relationship on the rearward surface of said front cover for connection to mating contacts of a second wiring device upon the coupling of the two wiring devices;

each of said contact blades having a frontward and a rearward end, the frontward end of each blade being disposed in substantial alignment with a respective one of said openings;

a plurality of electrical terminals mounted within said housing;

at least two side covers composed of electrical insulating material for enclosing said terminals, each of said side covers having an edge portion;

a plurality of web hinges joining the edge portions of both of said side covers to said first side edge of said front cover in juxtaposed relationship to form a unitary structure, said hinges mounting said side covers from said first side edge of said front cover for pivotal movement about respective axes which are substantially parallel to said longitudinal axis;

said terminals extending laterally from the rearward ends of respective ones of said blades toward said side covers.

16. The device according to claim 15 and further comprising:

a third side cover composed of an electrical insulating material, said third side cover having an edge portion joined by means of a web hinge to said second edge portion of said front cover for pivotal movement relative to said housing about a third axis which is substantially parallel to said longitudinal axis; and, at least one other electrical terminal facing said third side cover to which an electrical conductor is connectable.

17. The device according to claim 15 or 16, wherein each of the terminals has an insulation displacement means integral therewith, each insulation displacement means facing a respective one of said side covers.

18. The device according to claim 17, and further comprising:

a plurality of pockets integral with said front cover and depending rearwardly from said rearward surface of said front cover for electrically insulating each of said terminals from one another.

19. The device according to claim 18, wherein said insulation displacement means is rearwardly of said pockets and in substantial alignment therewith.

20. The device according to claim 19, wherein said insulation displacement means comprises:

an open-ended slot in a conductive blade for penetrating insulation covering a conductor pushed into the slot by one of said pusher members, the open ends of the slots in the conductive blades being substantially aligned rearwardly of the open sides of corresponding ones of said pockets.

21. The device according to claim 20, wherein each of said side covers has an inwardly extending cover portion located rearwardly of said conductive blades when said side covers are closed.

22. The device according to claim 21, wherein the inwardly extending cover portions of said side covers are formed of substantially U shape with the open ends thereof facing inwardly of the device when said side covers are closed, said cover portions being dimensioned to grip conductors pushed into said slots in said conductive blades by said pusher blocks.

23. The device according to claim 22, and further comprising:

a grounding conductor mounted on the rear of the device positioned between the inwardly extending cover portions of said side covers.

24. The device according to claim 17, wherein each of said insulation displacement means comprises;

a slotted portion in a conductive blade having inner edges for penetrating insulation on a conductor forced into the slotted portion; and, means on each of said side covers for restraining the conductors against displacement relative to said terminals when the side covers are closed.

25. The device according to claim 24, wherein each conductive blade has a slotted portion and further comprising:

a plurality of pusher members projecting from the interior wall of each of said side covers into respective ones of said slotted portions when said side covers are closed.

26. The device according to claim 25 wherein said pusher members are formed as integral parts of said side covers and have arcuate pusher surfaces.

27. The device according to claim 26 wherein each of said side covers has a substantially "L" cross-sectional shape, the longer portion of the L joined to the web hinges and the shorter portion of the L having a recess formed therein for clamping conductors connected to said terminals.

28. The device according to claim 27, wherein the shorter portion of the L of said first side cover is in an opposed, aligned relationship with the shorter portion of the L of said third side cover when said first and third side covers are closed.

29. The device according to claim 28, and further comprising:

an electrically conductive elongated strap mounted on said housing and extending substantially parallel to said longitudinal axis of said front cover and having a segment thereof intermediate the shorter portions of said first and third side covers when such side covers are closed.

30. The device according to claim 29, wherein each of said pockets is of substantially U cross-sectional shape with the open side thereof facing opposite one of said side covers.

31. The device according to claim 30, and further comprising:

a plurality of pusher blocks projecting from the interior wall of each of said side covers opposite different ones of said pockets;

said pusher blocks entering the open sides of said pockets upon closure of corresponding side covers.

32. An electrical duplex receptacle comprising:

a housing of insulating material having a front plate and a plurality of side plates;

the insulating material of the front plate forming at least two sets of apertures therethrough, each set of apertures for receiving the blades of an electrical plug;

said front and side plates being integrally interconnected by a web of said insulating material which forms a hinge connection between said front and side plates, so that said side plates are pivotable toward and away from one another to close and open said housing;

electrical contact members within said housing aligned with the apertures in said front plate, each of said contact members having an insulation penetrating portion;

at least two of said insulation penetrating portions facing one of said pivotable side plates;

a plurality of breakoff conductive members, each connected between an electrical contact member aligned with an aperture of one set and an electrical contact member aligned with an aperture of the second set, to convert said receptacle to a split circuit mode; and, at least two pusher members formed integral with the interior surface of said one side plate, each pusher member being aligned with one of said insulation penetrating portions, for forcing an insulation-covered conductor against either one or both of said insulation penetrating portions to make electrical connection to said receptacle.

33. An electrical duplex receptacle comprising:

a housing of insulating material having a front plate and a plurality of side plates;

the insulating material of the front plate forming at least two sets of apertures therethrough, each set of apertures for receiving the blades of an electrical plug;

said front and side plates being integrally interconnected by a web of said insulating material which forms a hinge connection between said front and side plates, so that said side plates are pivotable toward and away from one another to close and open said housing;

electrical contact members within said housing aligned with the apertures in said front plate, each of said contact members having an insulation penetrating portion;

at least two of said insulation penetrating portions facing one of said pivotable side plates, said front plate including integral, rearwardly extending walls which define open-sided pockets of insulating material each of which borders the area of one of said insulation penetrating portions.

at least two pusher members on the interior surface of said one side plate, each said pusher member being aligned with one of said insulation penetrating portions, for forcing an insulation-covered conductor against either one or both of said insulation penetrating portions to make electrical connection to said receptacle.

34. The receptacle as claimed in claim 33, wherein the walls defining said pockets are substantially of U cross-sectional shape for isolating the conductors from contacting one another.

35. The receptacle as claimed in claim 34, wherein the insulation penetrating portions each have a V-shaped slot.

36. The receptacle as claimed in claim 35, wherein the walls of said pockets coact with the side plates to form individual enclosures within the housing into which the conductors extend.

37. An electrical duplex receptacle comprising:

a housing of insulating material having a front plate and a plurality of side plates;

the insulating material of the front plate forming at least two sets of apertures therethrough, each for receiving the blades of an electrical plug;

said front and side plates being integrally interconnected by a web of said insulating material which forms a hinge connection between said front and side plates, so that said side plates are pivotable toward and away from one another to close and open said housing;

a separate body member formed of insulating material and having recesses for receiving and holding electrical contact members;

electrical contact members located within the recesses of said body member and aligned with the apertures in said front plate;

said front plate having rearwardly extending integral projections which project into recesses in said body member to provide channels to receive electrical wires to be connected to said receptacle; and, said side plates having surface areas which mate with said rearward projections to enclose the electrical wires, when said side plates are in a closed position.

38. A duplex receptacle as in claim 37, and further comprising:

a plurality of insulation penetrating contacts, each electrically connected to one of said electrical contact members; and, each of said insulation penetrating contacts being aligned with one of said pockets.

39. A duplex receptacle of generally rectangular shape and having front and rear wall portions comprising:

a plurality of opposing side covers hinged to the front wall portion of the receptacle;

a plurality of rear cover sections each joined to one of said side covers and extending inwardly toward each other so that the edges thereof lie in opposed spaced-apart positions to form part of the rear wall portion of the receptacle;

said front cover having apertures extending therethrough;

said front cover, side covers and rear covers composed of an insulating material and formed as a unitary structure;

an elongated strip of electrically conductive material mounted on said rear wall portion of said receptacle intermediate the edges of said rear covers and having opposite ends thereof extending frontwardly to a position adjacent said front cover; and, an electrical contact electrically connected to said strip and communicating with an aperture extending through said front cover.

40. The receptacle as claimed in claim 39, wherein each of said rear covers has a plurality of spaced-apart edges of substantially U shape formed therein to define a plurality of slots which open toward said strip, the walls defining said slots being dimensioned to accommodate a conductor connected to the receptacle.

41. A method of making a duplex receptacle comprising the steps of:

forming insulating material into a front plate with at least two sets of apertures therethrough and integral side covers, with the insulating material thinned in the regions where the side covers are attached to the front plate to provide a web hinge connection for each of the side covers, forming a separate body member to have pockets to house electrical contact members, inserting electrical contacts into the pockets in said body member, holding said body member to said front plate with a straplike yoke member, attaching said yoke member to the rear surface of said front plate to hold said body member behind said front plate with the contacts in the body member in alignment with the apertures in said front plate, and engaging a screw through each of said side covers into said body member for controlling the position of said side covers.

42. The method of claim 44 and further comprising the steps of:

inserting the ends of conductive wires into said receptacle to make electrical contact to said contact members with the side covers at least partially open and, rotating said screw to close said side member and to force the conductive wires against said contact members.

* * * * *